US007275978B2

(12) United States Patent
Tagscherer

(10) Patent No.: US 7,275,978 B2
(45) Date of Patent: Oct. 2, 2007

(54) HAND POWER TOOL WHICH RECEIVES ITS OPERATING VOLTAGE FROM A POWER SUPPLY UNIT

(75) Inventor: Theo Tagscherer, Gaildorf (DE)

(73) Assignee: Robert Bosch GmbH, Stuttgart (DE)

( * ) Notice: Subject to any disclaimer, the term of this patent is extended or adjusted under 35 U.S.C. 154(b) by 122 days.

(21) Appl. No.: 11/132,001

(22) Filed: May 18, 2005

(65) Prior Publication Data

US 2005/0260923 A1 Nov. 24, 2005

(30) Foreign Application Priority Data

May 22, 2004 (DE) ..... 10 2004 025 231

(51) Int. Cl.
*B24B 49/00* (2006.01)

(52) U.S. Cl. ..... 451/5; 451/359

(58) Field of Classification Search ..... 451/5, 451/8, 344, 357, 358, 359
See application file for complete search history.

(56) References Cited

U.S. PATENT DOCUMENTS

2002/0175648 A1* 11/2002 Erko et al. ..... 318/560

FOREIGN PATENT DOCUMENTS

DE 298 16 673 U1 11/1999

* cited by examiner

*Primary Examiner*—Eileen P. Morgan
(74) *Attorney, Agent, or Firm*—Michael J. Striker

(57) ABSTRACT

A hand power tool is connectable to a power supply unit via a multi-wire cable including a plurality of lines for delivering an operative voltage, and the power supply unit is adjustable by an electronic control unit to one or more operating parameters adapted to whichever hand power tool is connected to it, and a structure is provided which, when the hand power tool is put into operation, delivers information to the electronic control unit about the operating parameter or operating parameters to be adjusted.

4 Claims, 2 Drawing Sheets

HAND POWER TOOL WHICH RECEIVES ITS OPERATING VOLTAGE FROM A POWER SUPPLY UNIT

CROSS-REFERENCE

The invention described and claimed hereinbelow is also described in DE 10 2004 025 231.9, filed May 22, 2004. This German Patent Application, whose subject matter is incorporated here by reference, provides the basis for a claim of priority of invention under 35 U.S.C. 119 (a)-(d).

BACKGROUND OF THE INVENTION

The present invention relates to a hand power tool.

More particularly, it relates to a hand power tool which receives its operating voltage from a power supply unit; the hand power tool is connectable to the power supply unit via a multi-wire cable which has a plurality of lines for delivering the operating voltage.

As can be learned from German Utility Model DE 298 16 673 U1, the power supply unit for the hand power tool includes a frequency changer. Electrical tools in industrial use, in particular, have rotary current asynchronous motors with an elevated operating frequency compared to the line frequency (50 Hz). Converting alternating current to the requisite three-phase rotary current is also done in the power supply unit.

SUMMARY OF THE INVENTION

The object of the invention is to provide a hand power tool, with a power supply unit furnishing its operating voltage, of the type defined at the outset in which the power supply unit can operate different hand power tools using different operating parameters.

This object is attained in that the power supply unit is adjustable, by means of an electronic control unit, to one or more operating parameters adapted to the particular hand power tool connected to it, and means are provided which, when the hand power tool is put into operation, offer information to the electronic control unit about the operating parameter or operating parameters to be adjusted. The switchover to the requisite operating parameters in the electronic control unit is accordingly done automatically when the hand power tool connected to the electronic control unit is put into operation. Hence there is no need for switchovers of the power supply unit to be done by hand, for adjusting its operating parameters to whichever hand power tool is connected to it.

It is expedient that the multi-wire cable includes at least one coding line by way of which the electronic control unit, when whichever hand power tool is connected to the power supply unit is switched on, receives a signal characteristic of that particular hand power tool, with which signal one or more predetermined operating parameters are associated in the electronic control unit. To that end, the signal transmitted via the at least one coding line may have two states. One of the two signal states occurs because a pulse, formed when the hand power tool is switched on, is fed to the coding line, and the other signal state occurs because the pulse occurring when the hand power tool is switched on is not switched through to the coding line. Thus with a single coding line, two different states can be transmitted to the electronic control unit of the power supply unit, and the power supply unit associates one of more different operating parameters to each of these states.

In a very simple version of the coding of the operating parameters, the multi-wire cable includes two control lines, by way of which the power supply unit of a hand power tool connected to it carries a low voltage; there is a switch in the hand power tool which when the hand power tool is switched on short-circuits the control lines to one another, whereupon the electronic control unit receives a signal to switch the operating voltage through from the power supply unit to the hand power tool; and the switch, upon short-circuiting the two control lines feeds a pulse to the at least one coding line connected to the switch.

Adjustable operating parameters may for instance be the operating voltage and/or the operating frequency and/or the operating current and/or the startup time for the motor of the hand power tool and/or the braking time for the motor of the hand power tools.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
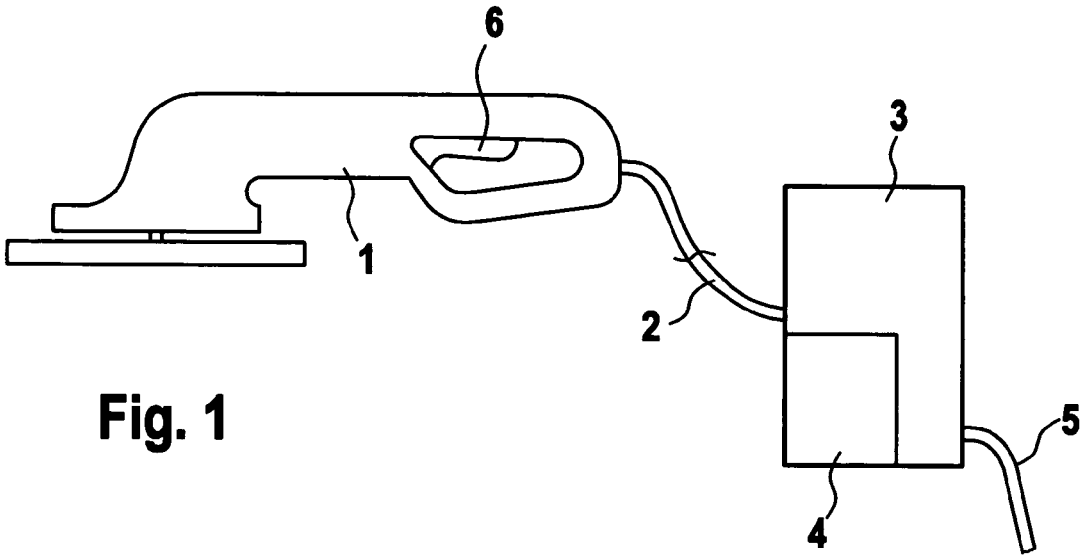
FIG. 1 shows a hand power tool connected to a power supply unit.

FIG. 1 shows a hand power tool 1, which is connected via a multi-wire cable 2 to a power supply unit 3. This power supply unit 3 includes a frequency changer, which converts the line frequency of 50 Hz to a higher operating frequency, for instance 300 Hz or 400 Hz and converts the alternating line voltage into a 3-phase operating voltage for supply to a rotary current asynchronous motor of the hand power tool 1. If the frequency conversion is done by means of a semiconductor power unit, the term typically used is static frequency changer.

There is an electronic control unit 4 in the power supply unit 3 that is capable of adjusting the power supply unit to different operating parameters, depending on which type of hand power tool 1 is connected to the power supply unit 3. For instance, different types of angle sanders (such as that shown in FIG. 1), or various types of power screwdrivers or saws, and so forth, may be connected to the power supply unit 3.

For each possible group of different hand power tools 1, the power supply unit 3 makes one or more operating parameters that are adapted to the hand power tool 1 available. This operating parameters are adjustable by means of the electronic control unit 4. The adjustable operating parameters may for instance include the operating voltage and/or the operating frequency and/or the operating current and/or the startup time for the motor of the hand power tool and/or the braking time for the motor of the hand power tool. For instance, for one group of hand power tools, an operating voltage of 200 V and an operating frequency of 300 Hz may be furnished, while for another group of hand power tools an operating voltage of 220 V and an operating frequency of 400 Hz may be furnished.

Reference numeral 5 indicates a cable for connection to the line voltage, by way of which the power supply unit 3 receives its power supply from the grid.

Figure 2:
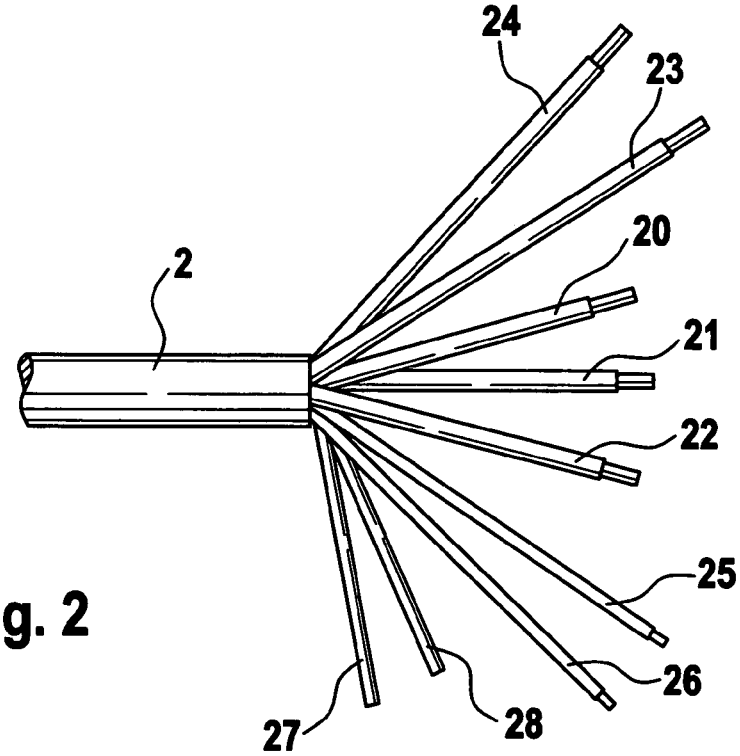
FIG. 2 shows the hand power tool with the multi-wire cable connecting it to the power supply unit.

As discussed in greater detail hereinafter, there is a connection between the hand power tool 1 connected to the power supply unit 3 that upon actuation of the button 6 for switching the hand power tool 1 on and off, the electronic control unit 4 in the power supply unit 3 receives information about at least one operating parameter required by whichever hand power tool 1 is connected to it. This information about the at least one operating parameter to be adjusted is received by the electronic control unit 4 in the power supply unit 3 from the hand power tool 1 via the multi-wire cable 2 that connects the two. FIG. 2 shows how this multi-wire cable 2 is constructed. For supplying energy to the rotary current asynchronous motor in the hand power tool 1, there lines 20, 21 and 22 for the three phases U, V and W. The line 23 acts as a ground conductor, and the line 24 acts as a shield for the multi-wire cable 2. There are moreover two control lines 25 and 26, by way of which a low voltage (such as 15 V) is delivered to the hand power tool 1 connected to the power supply unit 3 that is connected to the grid.

Finally, the multi-wire cable 2 has two coding lines 27 and 28. These two coding lines serve to transmit the aforementioned information about the operating parameter or operating parameters to be adjusted from the hand power tool 1 to the electronic control unit 4 in the power supply unit 3.

Figure 3A:
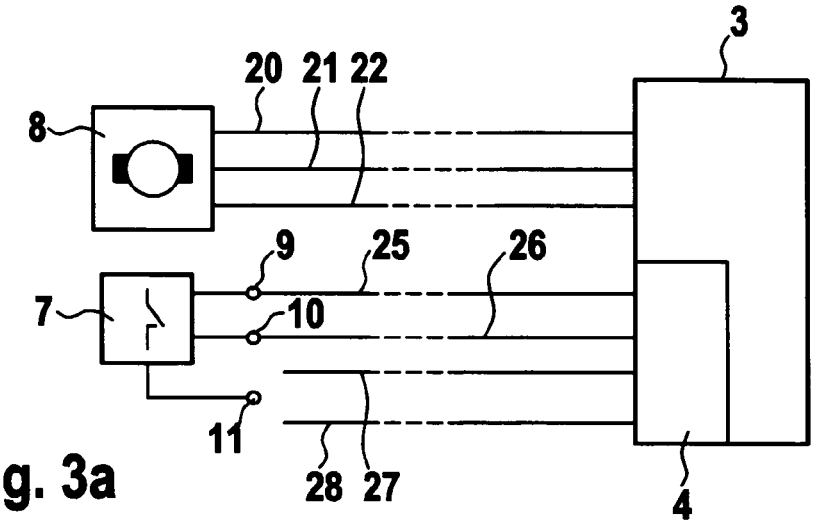
FIGS. 3*a* through 3*c* show three possible ways of connecting two coding lines, belonging to the multi-wire cable, to a switch of the hand power tool.
Figure 3B:
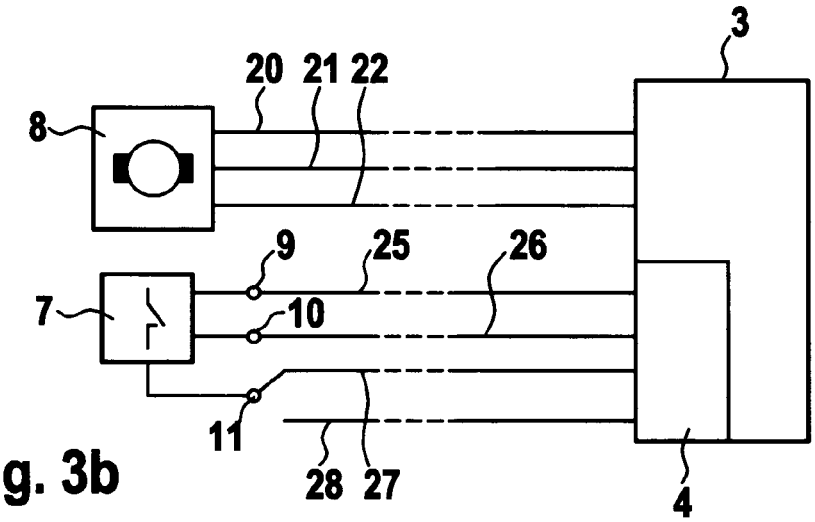
Figure 3C:
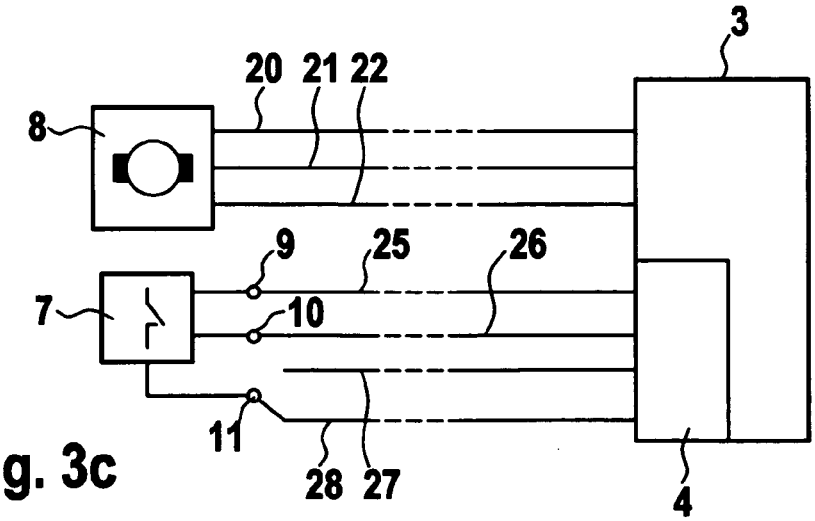

In FIGS. 3*a* through 3*c*, a switch 7 is symbolically shown, which is located in the hand power tool 1 and is actuatable by the button 6. With this switch, the energy delivery from the power supply unit 3 via the three-phase lines 20, 21, 22 to the rotary-current asynchronous motor 8 in the hand power tool 1 can be switched on and off. This switch 7 has a plurality of terminals 9, 10 and 11. With the terminals 9 and 10, the two control lines 25 and 26 connected to the electronic control unit 4 of the power supply unit 3 are electrically contacted. The electronic control unit 4 feeds a low voltage, for instance of 15 V, into the control lines 25, 26. If the switch 7 is then closed, the low-voltage circuit between the two control lines 25 and 26 is also closed, thereby signalling to the electronic control unit 4 to switch the operating voltage through to the three-phase lines 20, 21, 22.

The third terminal 11 on the switch 7 is provided for connecting the coding line 27 and/or 28. Whenever the switch 7 is actuated for short-circuiting the two control lines 25 and 26 and thus for switching on the delivery of energy to the rotary-current asynchronous motor 8 in the hand power tool 1, the switch 7 outputs a pulse to its terminal 11. This pulse can now be transmitted to the electronic control unit 4 in the power supply unit 3, via one or the other coding line 27, 28.

In FIGS. 3*a* through 3*c*, three variants are shown for connecting the coding lines 27, 28 to the terminal 11 of the switch 7. In FIG. 3*a*, neither of the two coding lines 27, 28 is connected to the terminal 11, and so when the switch 7 is switched on, no pulse is transmitted to the electronic control unit 4 via the coding lines 27 and 28. In the circuit variant shown in FIG. 3*b*, only the coding line 27 is connected to the terminal 11 of the switch 7, and in the circuit variant shown in FIG. 3*c*, only the coding line 28 is connected to the terminal 11 of the switch 7. With the three circuit variants shown, three different pieces of information, which can be associated with the different types of hand power tools 1, can be transmitted to the electronic control unit 4.

In each of these different pieces of information, that is, 1) no pulse on either of the coding lines 27 and 28,
2) a pulse on the coding line 27, and
3) a pulse on the coding line 28, the electronic control unit 4 adjusts the power supply unit 3 to one or more other operating parameters. The association among the operating parameters that can be furnished by the power supply unit 3 and the respective type of hand power tool 1 can accordingly be established merely by provided either that neither of the coding lines 27, 28 is put in communication with the terminal 11 of the switch 7 when the multi-wire cable 2 is attached to the hand power tool, or only on of the coding lines, that is, either the coding line 27 or the coding line 28, is connected to the terminal 11.

While in the exemplary embodiment described in conjunction with FIGS. 3*a* through 3*c* only three variants for adjusting various operating parameters adapted to a particular hand power tool 1 have been provided, it is possible with more than only two coding lines to attain still other variant associations of operating parameters with hand power tools. In the simplest case, it is possible for only a single coding line to be provided, which is either connected to the terminal 11 of the switch 7, or not, so that two different operating parameters or two different groups of operating parameters are feasible.

It will be understood that each of the elements described above, or two or more together, may also find a useful application in other types of constructions differing from the types described above.

While the invention has been illustrated and described as embodied in a hand power tool which receives its operating voltage from a power supply unit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A hand power tool assembly, comprising:

a hand power tool selected from various types of hand power tools;

a power supply unit providing operating voltage for said hand power tool;

a multi-wire cable connecting said hand power tool with said power supply unit and having a plurality of lines for delivering an operating voltage;

an electronic control unit operative for adjusting parameters of said power supply unit to one or more operating parameters adapted to the selected type of said hand power tool connected with said power supply unit; and means which, when said hand power tool is switched on, transmit information from said hand power tool to said electronic control unit about said operating parameter or operating parameters to be adapted to the hand power tool, wherein said multi-wire cable includes at least one coding line, wherein said at least one coding line, when said hand power tool is switched on, serves to transmit information via a signal that is characteristic of the selected hand power tool from said hand power tool to said electronic control unit about said operating parameter or operating parameters to be adapted to the selected hand power tool, wherein said multi-wire cable further includes at least one control line, and further comprising a switch provided in said hand power tool to switch said hand power tool on and off, wherein when the switch is closed, the operating voltage is delivered from said power supply to said hand power tool and said switch feeds a pulse to said at least one coding line which is connected to said switch.

2. A hand power tool assembly as defined in claim 1, wherein said signal of said hand power tool has two signal states, wherein in one of the two signal states, a pulse, which is formed when said hand power tool is switched on, is transmitted from said hand power tool to said electronic control unit via said at least one coding line, and in the other signal state, said pulse is not transmitted from said hand power tool to said electronic control unit via said at least one coding line.

3. A hand power tool assembly as defined in claim 2, wherein said multi-wire cable includes two control lines which deliver a low voltage from said power supply unit to said hand power tool; and wherein when the switch is closed said two control lines are short-circuited to one another; and wherein upon short-circuiting said control lines the operating voltage is delivered from said power supply unit to said hand power tool and said switch feeds a pulse to said at least one coding line which is connected to said switch.

4. A hand power tool assembly as defined in claim 1, wherein said power supply unit is adjustable by said electronic control unit to an operating parameter selected from the group consisting of an operating voltage, an operating frequency, an operating current, a startup time for a motor of said hand power tool, a braking time for the motor of said hand power tool, and combinations thereof.

* * * * *